United States Patent [19]

Dayan

[11] Patent Number: 4,819,437

[45] Date of Patent: Apr. 11, 1989

[54] METHOD OF CONVERTING THERMAL ENERGY TO WORK

[76] Inventor: Abraham Dayan, 27 Schaffer Rd., P.O. Box 115, Alpine, N.J. 07620

[21] Appl. No.: 197,505

[22] Filed: May 27, 1988

[51] Int. Cl.[4] ..... F01K 25/06

[52] U.S. Cl. ..... 60/673; 60/649

[58] Field of Search ..... 60/649, 673

[56] References Cited

U.S. PATENT DOCUMENTS 4,756,162 7/1988 Dayan ..... 60/673

*Primary Examiner*—Allen M. Ostrager

*Attorney, Agent, or Firm*—Browdy & Neimark

[57] ABSTRACT

A method is provided for converting sensible heat energy of a heating fluid supplied by a high-temperature heat source to work, by means of a thermodynamic cycle employing a multi-component working fluid, wherein a "rich solution" having a higher concentration of lower boiling component, or components, is heated in a vapor generator in counter-current heat exchange with the heating fluid to produce a vapor-liquid mixture which is introduced into a lower zone of a rectifier and separated therein into a "lean solution" having a higher concentration of said lower boiling component, or components, and a vapor mixture; the enthalpy of the vapor mixture is increased by passing it through a superheater in counter-current heat exchange with said heating fluid at its highest temperature; the vapor mixture is then expanded in a first turbine to an intermediate pressure level thereby to generate work and subsequently in a second turbine to a low pressure level to generate additional work; the spent vapor mixture is then recycled to an absorber wherein it is dissolved in said lean solution so as to regenerate said rich solution. The cycle is characterized mainly in that a portion of said lean solution emerging from the rectifier, is decompressed, by means of an expansion device, into a so-called flash drum wherein the lean solution separates into a yet leaner solution and a vapor mixture which is expanded in a turbine to produce additional work.

9 Claims, 2 Drawing Sheets

METHOD OF CONVERTING THERMAL ENERGY TO WORK

This invention concerns a method of converting sensible heat energy of a heating fluid supplied by a high-temperature heat source, such as the exhaust gases of a combustion turbine, to work, e.g. for the purpose of electrical power generation by employing a thermodynamic cycle operating with a multi-component working fluid system.

Multi-component working fluid thermodynamic cycles are well known and have been proposed and employed both in the field of power generation and refrigeration, as well as in other related fields. Such cycles employ a multi-component (in most cases a binary) working fluid system comprising at least one comparatively volatile fluid component (hereinafter "the lower boiling component") and at least one "carrier fluid" component having a considerably higher boiling temperature than said volatile fluid component and a high degree of absorptivity for the volatile fluid, so as to form a solution. Many of the multi-component thermodynamic cycles hitherto proposed and employed, operate with a binary or so-called "dual" working fluid system consisting of ammonia as the volatile fluid and water as the carrier fluid. Thus, for example, in a heat engine falling within this category, i.e. operating with an ammonia/water binary working fluid, a "rich" solution of ammonia in water is heated in a vapor generator (or boiler) so as to produce a gaseous mixture rich in ammonia and a residual dilute or "lean" solution. This high enthalpy gaseous mixture is expanded in a turbine to transform its energy into usable mechanical energy, whereafter the spent ammonia-rich gaseous mixture is passed to an absorber wherein it is reabsorbed, under cooling, in the lean solution drawn from the vapor generator, so as to regenerate a rich solution for recycling to the vapor generator.

As contrasted to the constant temperatures prevailing in the boiler and condenser of a pure-fluid Rankine cycle, the separation of a multi-component working fluid mixture in the vapor generator (or distiller), as well as the regeneration of the mixture of the fluid components in the absorber of such a multi-component cycle, take place over finite temperature ranges, owing to the gradual changes in the compositions of the various fluid mixtures which become gradually poorer or richer in the more volatile component, in the vapor generator and the absorber, respectively. This fact, inter alia, renders such multi-component working fluid thermodynamic cycles especially suitable for combination with a gas turbine in so-called combined power plants where the hot exhaust gases from a combustion process or a gas turbine serve as a sensible heat source of variable temperature, mainly for the vapor generator or boiler of the multi-component working fluid cycle.

An improved multi-component working fluid thermo-dynamic cycle of the above mentioned type is the subject of my co-pending patent application Ser. No. 040,835 filed Apr. 9, 1987 under the title "Method of utilizing thermal energy". In this cycle a "rich solution" having a higher concentration of lower boiling component, or components, is heated in a vapor generator in counter-current heat exchange with the heating fluid to produce a vapor-liquid mixture which is introduced into a lower zone of a rectifier and separated therein into a "lean solution" having a higher concentration of said lower boiling component, or components, and a vapor mixture; the enthalpy of the vapor mixture is increased by passing it through a superheater in counter-current heat exchange with said heating fluid at its highest temperature; the vapor mixture is then expanded in a turbine to a low pressure level thereby to perform the function of the cycle; and the spent vapor mixture is introduced into an absorber wherein it is dissolved in said lean solution, under heat rejection to an external coolant, so as to regenerate a rich solution. The cycle is characterized, inter alia, in that the pressure of the rich solution regenerated in the absorber is increased and a part of the solution is heated in a regenerative heat exchanger by counter-current heat exchange with the lean solution which is drawn from the rectifier, whereafter said lean solution is decompressed by means of an expansion device and fed to the absorber.

The primary concept underlying the present invention is the realization that in a thermodynamic cycle of the above type, the lean solution which emerges from the rectifier has an enthalpy considerably in excess of the amount needed to heat up the part of the rich solution, in a regenerative heat exchanger as described above, before its introduction into the vapor generator. This excess enthalpy of the lean solution is not utilized in hitherto proposed thermodynamic cycles and is eventually rejected from the cycle to the external coolant which cools the absorber. Thus, one of the main features of the novel cycle of the present invention, resides in that a portion of said lean solution emerging from the rectifier, is decompressed, by means of an expansion device, into a so-called flash drum wherein the lean solution separates into a yet leaner solution and a vapor mixture which is expanded in a turbine to produce additional work.

In accordance with a preferred embodiment of the invention the above process of decompressing a part of the lean solution is repeated twice or more, in two or more stages, each yielding a vapor mixture the enthalpy of which is advantageously converted to work in a turbine. The residual lean solution formed in the last stage is recirculated to the absorber.

The object of my present invention is thus to provide a further improved multi-component working fluid thermodynamic cycle having an increased thermodynamic efficiency and capable of utilizing the sensible heat energy of a high-temperature external energy source more efficiently than hitherto known cycles of this type.

The above object is achieved in accordance with the invention, which provides a method of converting sensible heat energy of a heating fluid supplied by a high-temperature heat source to work, by means of a thermodynamic cycle employing a multi-component working fluid, wherein:

a solution having a higher concentration of a lower boiling component, or components, (hereinafter "rich solution") generated in an absorber is pressurized by means of a pump and is divided into at least a first and a second parts;

said first part of the rich solution is passed through a preheater in indirect counter-current heat exchange with the partially exhausted heating fluid emerging from a vapor generator, whereby said first part of the rich solution extracts additional heat from said heating fluid and is heated to the liquid saturation state;

said second part of the rich solution is passed through a regenerative heat exchanger so as to extract heat from at least one internal stream of the cycle by indirect counter-current heat exchange, and is then introduced, optionally together with a portion of said first part of the rich solution emerging from said preheater at the liquid saturation state, into said vapor generator and heated therein by indirect counter-current heat exchange with the heating fluid to produce a vapor-liquid mixture;

said vapor-liquid mixture generated in the vapor generator is fed into a lower zone of a rectifier for counter-current mass and heat exchange with at least a portion of said first part of the rich solution emerging from said preheater at the liquid saturation state which is fed into an upper zone of the rectifier, thereby forming a solution having a lower concentration of said lower boiling component, or components, (hereinafter "first lean solution") and a first vapor mixture having an increased concentration of the lower boiling component or components;

the enthalpy of said first vapor mixture is increased by passing it through a superheater in counter-current heat exchange with said heating fluid at its highest temperature; the first vapor mixture is then expanded in a first turbine to an intermediate pressure level; thereby to generate work;

a first part of said first lean solution emerging from the rectifier is passed through said regenerative heat exchanger for counter-current heat transfer to said second part of the rich solution, and is then decompressed to a low pressure level by means of a first expansion device and fed to said absorber;

a second part of said first lean solution emerging from the rectifier is decompressed by means of a second expansion device to said intermediate pressure and is introduced into a flash drum wherein it separates into a second vapor mixture and a second lean solution;

said second vapor mixture is combined with the partially spent first vapor mixture from said first turbine and the combined vapor mixture is expanded in a second turbine to said low pressure level, thereby to generate additional work;

said second lean solution is decompressed to said low pressure level by means of a third expansion device and fed to the absorber; and the combined spent vapor mixture from said second turbine is introduced into the absorber wherein to dissolve in the combined first part of said first lean solution and said second lean solution, under heat rejection to an external coolant, so as to regenerate said rich solution.

Various parameters of the thermodynamic cycle according to the invention, e.g. said high, intermediate and low pressures, the mass flow rates in the various fluid streams and the concentrations of the lower boiling component (or components) in these streams, will be adjusted by conventional means and in a manner which should be clear to the skilled man of the art, so as to optimize the performance of the cycle, i.e. to achieve a maximum thermal efficiency. This applies in particular to the composition of the rich solution (i.e. the proportions of higher and lower boiling components thereof), to the relative amounts of said first and second parts of the rich solution and of said first and second parts of said first lean solution and to the relative amount, if any, of the portion of said first part of the rich solution which is optionally introduced into the vapor generator.

In accordance with a preferred embodiment of the invention, the absorber is of the heat recuperative type wherein the regenerated rich solution is recirculated through the absorber through continuous flow channels in an indirect heat exchange relationship with the fluid mixture in the absorber so as to extract a substantial portion of the heat of absorption generated in the absorber. More preferably, the absorber is a multiple-stage recuperative absorber as disclosed in Kogan et al., U.S. Pat. No. 4,534,175.

In accordance with another preferred embodiment of the invention, the rich solution in the vapor generator is heated not only by the heating fluid, but also by internal heat recovered from the cycle via one or more internal working fluid streams circulated in indirect counter-current heat exchange relationship with a portion of the rich solution passing through the vapor generator.

The invention will now be described in more detail and its advantages explained, having reference to the accompanying non-limiting drawings, in which.

Figure 1:
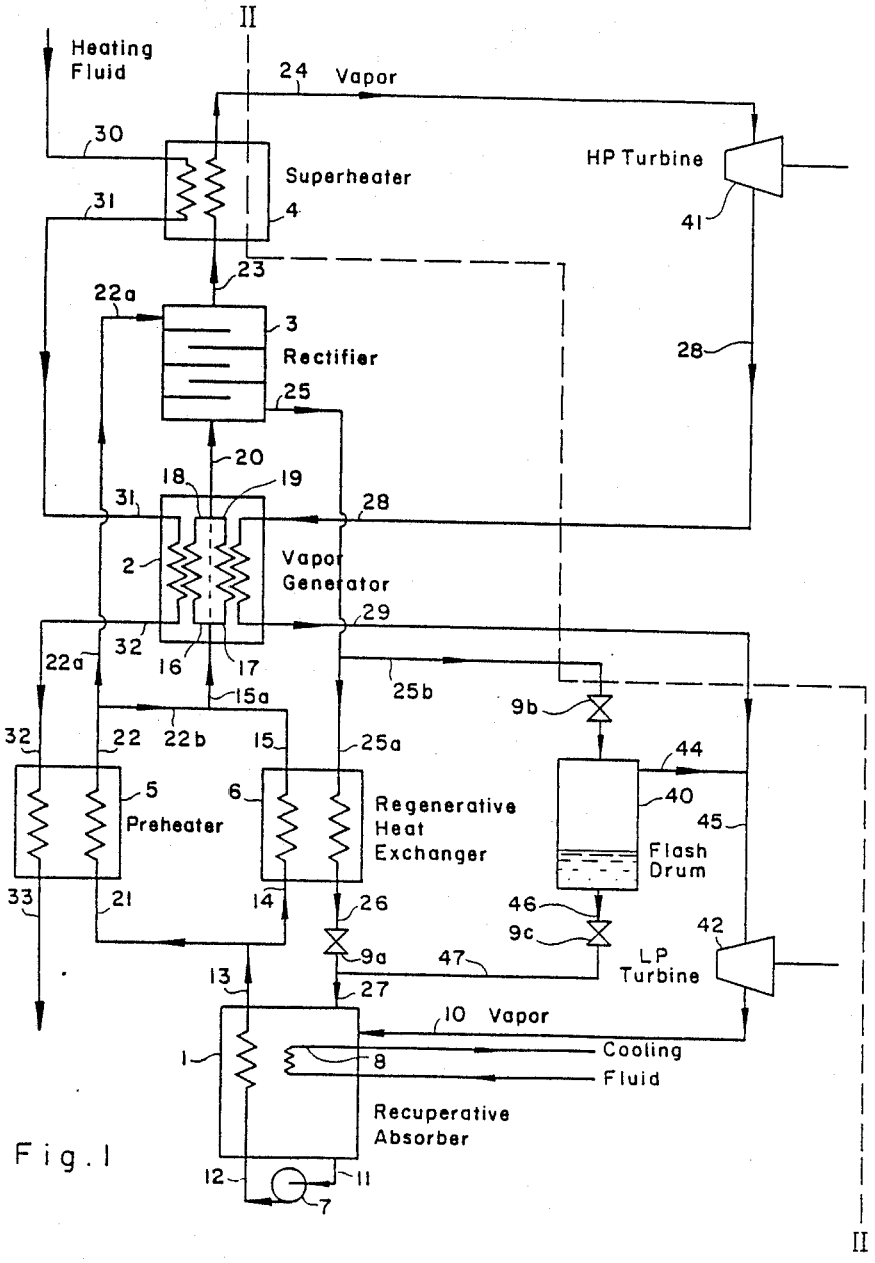
FIG. 1 is a schematic flow sheet representing a basic multi-component working fluid thermodynamic cycle in accordance with one embodiment of the invention.

The principles of the novel thermodynamic cycle according to the present invention, incorporating the two preferred embodiments mentioned above, are schematically illustrated in FIG. 1 of the accompanying drawings. The cycle depicted in FIG. 1 comprises a recuperative absorber 1, a vapor generator 2, a rectifier 3, a superheater 4, a preheater 5, a regenerative heat exchanger 6, a pump 7 for compressing and recirculating the rich solution to the absorber 1, an external cooling fluid system 8 for cooling the fluid mixture in the absorber 1, expansion devices 9*a*, 9*b* and 9*c*, a flash drum 40, a first, high pressure turbine 41 and a second, low pressure turbine 42.

In operation, a spent vapor mixture 10, which may contain some condensate liquid, at a comparatively low pressure, enters the absorber 1 wherein it is condensed by absorption in a lean solution 27. The absorber 1 is preferably a multi-stage heat recuperative absorber, in which case the lean solution 27 and the spent vapor mixture 10 are introduced into the absorber 1 at opposite ends thereof in counter-current flow to each other. A desired portion of the heat of absorption generated in the absorber 1 is rejected to an external cooling fluid circulating through the cooling system 8. The rich solution 11 regenerated in the absorber 1 is compressed to a high pressure by the pump 7 and the compressed rich solution 12 is recirculated back into the absorber 1, preferably in a direction from the lowest to the highest temperature zones therein, so as to gain heat from the entering spent vapor mixture 10 and from the absorption process. The heated and pressurized rich solution 13 leaving the absorber is divided into a first part 21 and a second part 14.

The first part of the rich solution 13 leaving the absorber 1 in stream 21, is passed through the preheater 5 in counter-current heat exchange relationship with the stream 32 of the heating fluid emerging from the vapor generator 2. In this process, residual sensible heat of the heating fluid in stream 32 is transferred to the rich solution in stream 21 which is thereby heated substantially to its saturation state, and leaves the heat exchanger 5 as stream 22, without vapor but ready for vaporization upon further heating, whereas the exhausted heating fluid leaves the preheater 5 as stream 33.

The second part of the rich solution in stream 14 is first heated in the regenerative heat exchanger 6 by counter-current heat exchange with a first part 25*a* of the first lean solution 25 drawn from the lower zone of the rectifier 3. In this process, the rich solution is heated to afford the stream 15 and could develop some vapor, while the first part of the first lean solution 25*a* is cooled to afford the stream 26 which is then decompresed to a low pressure level by passage through the expansion device 9*a* to afford a part of the lean solution stream 27 fed to the absorber 1. The thus heated rich solution stream 15 is combined, if desired, with a portion 22*b* of the stream of rich solution 22 emerging from preheater 5 at the saturation stage. The combined rich solution stream 15*a* is fed to the vapor generator 2 wherein it is divided into two streams 16 and 17. The vapor generator 2 is constructed as an indirect counter-current heat exchanger consisting of two parts. One rich solution stream 16 is introduced into one part of this heat exchanger wherein it is heated to partial or full vaporization by counter-current heat transfer from the heating fluid, i.e. the gaseous high temperature heat source which enters the vapor generator 2 at 31, leaving it at 32. The other rich solution stream 17 is passed through the other part of the counter-current heat exchanger of the vapor generator 2 wherein it is heated to partial or full evaporation by heat exchange with the partially spent vapor mixture leaving the first turbine 41 as stream 28 (see below) which leaves the vapor generator 2 as stream 29. The two heated streams 18 and 19 leaving the twp parts of the vapor generator 2 are combined into one stream 20 which feeds a mixture of vapors or a mixture of liquid and vapor into the lower zone of the rectifier 3.

The entire saturated stream 22 of the rich solution leaving the preheater 5, or a portion 22*a* thereof, is introduced into the upper zone of the rectifier 3 for direct heat and mass transfer in counter-current flow with the vapor/liquid mixture that is introduced in stream 20 into the lower zone of the rectifier 3. In this heat and mass transfer process there are formed a first lean liquid solution which is collected at the bottom zone of the rectifier 3 and emerges therefrom as stream 25 and a desired first vapor mixture which emerges from the upper zone of rectifier 3 as stream 23.

The vapor mixture stream 23 is passed through superheater 4 wherein it is further heated by counter-current heat exchange with the heating fluid at its highest temperature, which enters superheater 4 as stream 30 and leaves it as stream 31 to be fed into the vapor generator 2. The heated first vapor mixture leaves superheater 4 as stream 24 to the first turbine 41 and is expanded therein to an intermediate pressure level thereby to generate work. The partially spent first vapor mixture leaves turbine 41 as stream 28.

The first lean solution stream 25 emerging from the bottom zone of rectifier 3 is divided into the above mentioned first part 25*a* which is fed to the regenerative heat exchanger 6, and a second part 25*b* which is decompressed to said intermediate pressure level by means of the expansion device 9*b* and introduced into the flash drum 40 wherein it separates into a second vapor mixture and a second lean solution.

The second vapor mixture emerges from the upper zone of flash drum 40 as stream 44. This stream 44 is combined with the partially spent vapor mixture in stream 29, and the thus combined vapor mixture stream 45 at said intermediate pressure is expanded in the second turbine 42 to said low pressure level, thereby to generate additional work. The combined spent vapor mixture leaves the second turbine 42 as stream 10 which is recirculated to the absorber as explained above.

The second lean solution formed in flash drum 40 is drawn from the lower zone thereof as stream 46, decompressed to said low pressure level by means of expansion device 9*c* and combined with the decompressed first lean solution stream 26 to form the stream 27 of the lean solution fed to the absorber 1, as explained above.

The pressure and composition of the vapor mixture 23 leaving the rectifier 3 determine both the thermodynamic performance of the cycle and the efficiency of utilization of the heat source energy, and must be chosen so as to maximize them. These parameters, respectively, can be controlled within acceptable technological limits, by adjusting the setting of the pump 7 (i.e. the pressure of the rich solution stream 13 leaving the absorber 1) and the mass flow rate of the higher boiling component or components circulating between the absorber 1 and the rectifier 3 (via streams 11 to 22, 22*a*, 22*b*, 25 to 27 and 46 in FIG. 1). As stated above, the aforesaid parameters are preferably adjusted so that, for a selected flow rate of the vapor mixture stream 23, the vapor mixture leaves the superheater 4 as stream 24 at a maximum temperature.

The novel design of the multi-component working fluid thermodynamic cycle employed in the method of the present invention incorporates a number of improvements, all of which contribute to the resultant advantages of this cycle, namely increased thermodynamic efficiency of the cycle and better utilization of the sensible heat energy of the heat source (i.e. extracting more heat from the heating fluid or gas). Reference is made in this connection to my above mentioned copending patent application Ser. No. 040,835 wherein some of these improvements are disclosed and discussed in detail.

One general principle underlying the design of the thermodynamic cycle was to approach thermodynamic reversibility, as much as possible, in the various sections of the cycle. As is well known in the art (cf. e.g., the aforementioned Kogan et al. U.S. Pat. No. 4,534,175), the compressed rich solution recirculated through the absorber, when this is of the recuperative type, may start to boil in the absorber or, particularly, during the passage of the first and second parts of this rich solution through the preheater and the regenerative heat exchanger, respectively. Since the boiling process of multi-component fluids also exhibits sensible heat characteristics (i.e. change of temperature with changes of energy content), one must consider the apparent heat capacities of each respective stream of working fluid in the cycle. Thus, the term "apparent heat capacity mass flow rate" used herein means, as should be clear to a man of the art, the mass flow rate of any specific stream multiplied by the apparent heat capacity of the fluid mixture of this stream (which may be a mixture of gas and liquid) averaged over the particular section of the path of this stream.

In line with the above, all preheaters in the cycle are preferably of the counter-current flow type in order to achieve higher temperatures in the heating process. A counter-current preheater becomes more reversible when the two counter-current streams carry equal heat capacity mass flow rates, because this provides for heat transfer under minimum approach temperature differences between the two streams, along the entire heat exchanger. Therefore, the temperature of the heated stream leaving the preheater can approach the initial temperature of the heating stream which in the heat exchange process gives up the maximum of its transferable sensible heat. This applies in particular to the regenerative heat exchanger (6 in FIG. 1) as will be explained in more detail hereinbelow.

The mass flow rate of the rich solution stream 14, in proportion to stream 21, may advantageously be determined so as to render the apparent heat capacity mass flow rate of stream 14 as close as is feasible to the apparent heat capacity mass flow rate of the stream 25*a* of the first part of the first lean solution which is introduced into the regenerative heat exchanger 6. As explained in my above mentioned patent application Ser. No. 040,835, this results in extraction of a maximum amount of the recoverable sensible heat of the lean solution stream 25*a* by transfer to the rich solution stream 14 which, as a result, leaves the regenerative preheater as stream 15 at a maximum temperature, relatively close to the temperature of the entering heating stream 25*a*.

The counter-current heating process in the vapor generator (2 in FIG. 1) also results in the following advantages, as compared to the so-called "pool heating" such as in the bottom of a distiller or boiler:

i. Higher temperatures of the boiling solution are reached, for a given heat source temperature, thereby increasing the quantity of vapor produced per unit mass of rich solution entering the vapor generator;

ii. More heat is extracted from the heating fluid which leaves the vapor generator at a considerably lower temperature than that of the boiling solution formed therein. (In "pool boiling" the heating fluid leaves the boiler at practically the same temperature as that of the heated fluid.);

iii. a vapor generator sructure as described above and illustrated in FIG. 1 enables the simultaneous use of different heat sources having different temperature ranges for the boiling process, thereby recovering heat energy from one or more internal streams of the cycle.

A more reversible heat and mass transfer is also achieved, in accordance with the invention, in the rectifier (3 in FIG. 1), the function of which is to supplement the vapor generator and to create a vapor mixture which is richer in the more volatile component of the working fluid. The heat and mass transfer process in the rectifier is performed in counter-current with little temperature differences between the descending saturated rich solution (stream 22*a* in FIG. 1) and the rising vapor mixture in the rectifier, resulting in a desired vapor composition with a high exit temperature (close to the temperature of the saturated solution entering the rectifier in stream 22).

Figure 2:
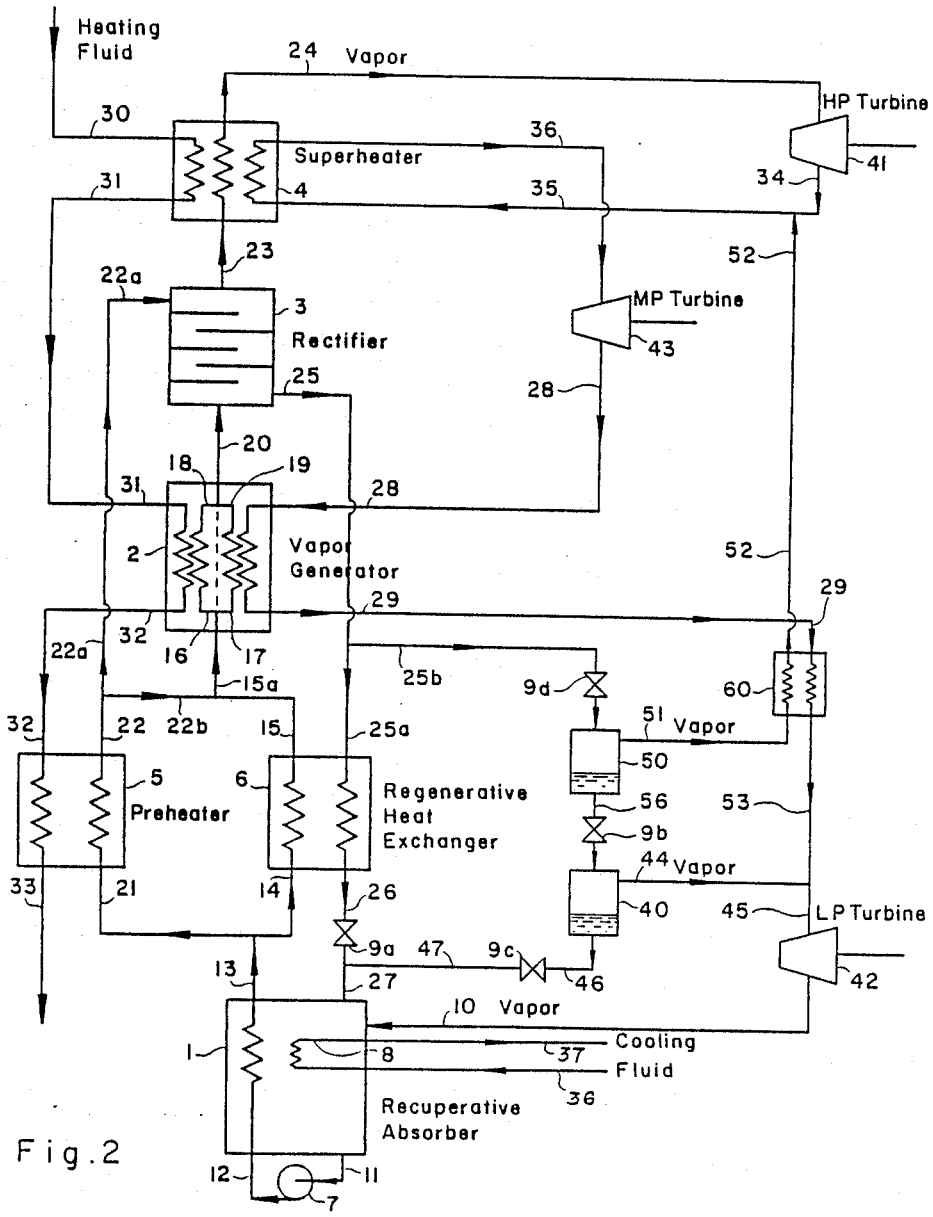
FIG. 2 is a schematic flow sheet representing a binary working fluid thermodynamic cycle in accordance with another embodiment of the present invention which operates with an ammonia/water working fluid system.

A more elaborate embodiment of the present invention is illustrated in FIG. 2 for the case of a binary ammonia/water working fluid and a high temperature exhaust gas from a gas turbine as the sensible heat source. As seen in FIG. 2, the cycle comprises essentially the same section which is illustrated in FIG. 1 to the left of the broken line II—II, and the same reference numerals are employed in FIG. 2 for the corresponding components and streams of the various fluids in the cycle. The remaining right-hand part of the cycle of FIG. 2 comprises two power turbines, namely a high pressure turbine 41 and an intermediate pressure turbine 43, a flash drum 50, expansion device 9d, a counter-current heatexchanger 60 and a reheat line 35–36 through superheater 4.

The cycle illustrated in FIG. 2 differs from the one of FIG. 1, mainly in that power generation is effected in the three turbines 41, 43 and 42 operating at a high, a first intermediate and a second intermediate pressure, respectively, and in that the decompression of part 25*b* of the first lean solution is effected in two stages, i.e. in the two flash drums 50 and 40, by means of the expansion devices 9*d* and 9*b*, respectively, to the first intermediate and the second intermediate pressures, respectively. This allows the vapor mixture stream 51 formed in the first flash drum 50 to participate in driving the first intermediate pressure turbine 43, while the final vapor mixture stream 44 formed in the second flash drum 40 is expanded in the second intermediate pressure turbine 42 as in the cycle described above with reference to FIG. 1.

Thus, the operation of that part of the thermodynamic cycle of FIG. 2 which corresponds to the section of the cycle of FIG. 1 to the left of the broken line II—II, is essentially the same and needs no further explanation. The same applies to the high pressure turbine 41 in FIG. 2, except that here the partially spent vapor mixture leaves turbine 41 at said first intermediate pressure level in stream 34 which is mixed with another stream 52 of high enthalpy vapor mixture (see below) and the combined stream 35 is recirculated through the superheater 4 so as to increase its enthalpy by counter-current heat exchange with the heating fluid stream 30 having the highest temperature. The combined heat capacity mass flow rates of streams 23 and 35 (34+52) which are fed to superheater 4 are more compatible than that of stream 23 alone, with the heat capacity mass flow rate of the heating fluid 30 and, therefore, the vapor reheat line contributes to the overall thermodynamic efficiency of the cycle. The superheated vapor mixture leaves superheater 4 in stream 36 and is expanded again to the second intermediate pressure in turbine 43 to produce additional mechanical work.

The partially spent vapor mixture from turbine 43 leaves it in stream 28, which is passed through the vapor generator 2 to transfer some of its thermal energy to the rich solution, as explained above in connection with FIG. 1. The vapor mixture leaves the vapor generator 2 as stream 29 and is passed through heat exchanger 60 for indirect counter-current heat transfer to the vapor mixture stream 51 emerging from the first flash drum 50. This vapor stream 51, after being thus heated, emerges from heat exchanger 60 as the above mentioned vapor stream 52 which is combined with vapor stream 34 from the high pressure turbine 41.

The partially spent vapor mixture 29 leaves heat exchanger 60 as stream 53 which is combined with the vapor mixture stream 44 emerging from the second flash drum 40 (as explained above in connection with FIG. 1) and the combined vapor mixture stream 45 is expanded in the low pressure turbine 42 to generate more mechanical work. The fully spent vapor mixture, leaving the low pressure turbine 42 as stream 10, is recirculated to the absorber 1 as explained above in connection with FIG. 1.

The advantage of the thermodynamic cycle according to the present invention is demonstrated by the following Table I showing the physical parameters of the various fluid streams in FIG. 2 (i.e. the working fluid, the heating fluid and stream 36 of the external cooling fluid entering the absorber 1), as calculated per unit mass flow rate of the first vapor mixture leaving the superheater as stream 24 to turbine 41.

TABLE I

| Stream No. | State | Vapor quality* | % NH (w/w)** | Pressure psia | Temp. F. | Mass flow rate lb/sec | Specific enthalpy BTU/lb |
|---|---|---|---|---|---|---|---|
| 13 | liq. | 0 | 48.9 | 2400 | 182 | 3.393 | 172 |
| 21 | liq. | 0 | 48.9 | 2400 | 182 | 1.829 | 172 |
| 22 | liq. | 0 | 48.9 | 2400 | 480 | 1.829 | 478 |
| 22b | liq. | 0 | 48.9 | 2400 | 480 | 0.777 | 478 |
| 22a | liq. | 0 | 48.9 | 2400 | 480 | 1.052 | 478 |
| 14 | liq. | 0 | 48.9 | 2400 | 182 | 1.565 | 172 |
| 15 | liq. | 0 | 48.9 | 2400 | 480 | 1.565 | 478 |
| 15a | liq. | 0 | 48.9 | 2400 | 480 | 2.341 | 478 |
| 20 | mix. | 0.4145 | 48.9 | 2400 | 505 | 2.341 | 636 |
| 23 | vapor | 1 | 65 | 2400 | 483 | 1.000 | 796 |
| 24 | vapor | 1 | 65 | 2400 | 950 | 1.000 | 1217 |
| 34 | vapor | 1 | 65 | 820 | 728 | 1.000 | 1090 |
| 35 | vapor | 1 | 66.9 | 820 | 665 | 1.325 | 1039 |
| 36 | vapor | 1 | 66.9 | 820 | 950 | 1.325 | 1236 |
| 28 | vapor | 1 | 66.9 | 189 | 657 | 1.325 | 1056 |
| 29 | vapor | 1 | 66.9 | 189 | 530 | 1.325 | 979 |
| 53 | vapor | 1 | 66.9 | 189 | 502 | 1.325 | 963 |
| 45 | vapor | 1 | 67.1 | 189 | 488 | 1.425 | 953 |
| 10 | vapor | 1 | 67.1 | 30 | 192 | 1.425 | 804 |
| 25 | liq. | 0 | 42.2 | 2400 | 504 | 2.393 | 500 |
| 25a | liq. | 0 | 42.2 | 2400 | 504 | 1.491 | 500 |
| 25b | liq. | 0 | 42.2 | 2400 | 504 | 0.902 | 500 |
| 51 | vapor | 1 | 72.6 | 820 | 398 | 0.325 | 816 |
| 52 | vapor | 1 | 72.6 | 820 | 490 | 0.325 | 883 |
| 56 | liq. | 0 | 25.2 | 820 | 398 | 0.578 | 323 |
| 44 | vapor | 1 | 70.2 | 189 | 299 | 0.100 | 826 |
| 46 | liq. | 0 | 15.7 | 189 | 299 | 0.477 | 217 |
| 26 | liq. | 0 | 42.2 | 2400 | 192 | 1.491 | 179 |
| 27 | mixture | 0.223 | 35.8 | 30 | 150 | 1.968 | 188 |
| 30 | gas | | | | 1050 | 6.954 | |
| 31 | gas | | | | 677 | 6.954 | |
| 32 | gas | | | | 530 | 6.954 | |
| 33 | gas | | | | 232 | 6.954 | |
| 36 | liq. | | | | 55 | | |

*mass vapor/mass (liquid + vapor)
**weight per weight

Based on the data in Table I, the thermal efficiency of the cycle illustrated by FIG. 2 is 27.5% (percent of the heating fluid inlet enthalpy converted to mechanical work with turbine efficiencies of 88%). This value is substantially higher than that of a steam Rankine cycle which typically would be below 24% for such a heat input. Furthermore, the embodiment illustrated in FIG. 2 can be additionally improved by the incorporation of a more elaborate network of heat exchangers, expansion devices and flash drums in between streams 25 and 27. Such a network could yield more vapor for work production by utilizing additional amounts of enthalpy, such as those left in streams 26 and 46, which are otherwise wasted. The improved thermal efficiency which can be obtained, e.g., by the addition to the cycle of FIG. 2 of two flash drums, one heat exchanger and one expansion device, is 28.6%.

What is claimed:

1. A method of converting sensible heat energy of a heating fluid supplied by a high-temperature heat source to work, by means of a thermodynamic cycle employing a multi-component working fluid, wherein:

a solution having a higher concentration of a lower boiling component, or components, (hereinafter "rich solution") generated in an absorber is pressurized by means of a pump and is divided into at least a first and a second parts;

said first part of the rich solution is passed through a preheater in indirect counter-current heat exchange with the partially exhausted heating fluid emerging from a vapor generator, whereby said first part of the rich solution extracts additional heat from said heating fluid and is heated to the liquid saturation state;

said second part of the rich solution is passed through a regenerative heat exchanger so as to extract heat from at least one internal stream of the cycle by indirect counter-current heat exchange, and is then introduced, into said vapor generator and heated therein by indirect counter-current heat exchange with the heating fluid to produce a vapor-liquid mixture;

said vapor-liquid mixture generated in the vapor generator is fed into a lower zone of a rectifier for counter-current mass and heat exchange with at least a portion of said first part of the rich solution emerging from said preheater at the liquid saturation state which is fed into an upper zone of the rectifier, thereby forming a solution having a lower concentration of said lower boiling component, or components, (hereinafter "first lean solution") and a first vapor mixture having an increased concentration of the lower boiling component or components;

the enthalpy of said first vapor mixture is increased by passing it through a superheater in counter-current heat exchange with said heating fluid at its highest temperature; the first vapor mixture is then expanded in a first turbine to an intermediate pressure level; thereby to generate work;

a first part of said first lean solution emerging from the rectifier is passed through said regenerative heat exchanger for counter-current heat transfer to said second part of the rich solution, and is then decompressed to a low pressure level by means of a first expansion device and fed to said absorber;

a second part of said first lean solution emerging from the rectifier is decompressed by means of a second expansion device to said intermediate pressure and is introduced into a flash drum wherein it separates into a second vapor mixture and a second lean solution;

said second vapor mixture is combined with the partially spent first vapor mixture from said first turbine and the combined vapor mixture is expanded in a second turbine to said low pressure level, thereby to generate additional work;

said second lean solution is decompressed to said low pressure level by means of a third expansion device and fed to the absorber; and the combined spent vapor mixture from said second turbine is introduced into the absorber wherein to dissolve in the combined first part of said first lean solution and said second lean solution, under heat rejection to an external coolant, so as to regenerate said rich solution.

2. A method according to claim 1 wherein the working fluid system consists of a mixture of ammonia and water.

3. A method according to claim 1, characterized in that the absorber is of the heat recuperative type wherein the regenerated rich solution is recirculated through the absorber through continuous flow channels in an indirect heat exchange relationship with the fluid mixture in the absorber so as to extract a substantial portion of the heat of absorption generated therein and of the heat of the spent vapor mixture introduced thereinto.

4. A method according to claim 3 wherein the absorber is a multiple-stage recuperative absorber.

5. A method according to claim 1 wherein at least one internal stream of working fluid is passed through the vapor generator for counter-current heat transfer to a portion of the rich solution therein, thereby recovering some of the heat energy of said internal stream (or streams).

6. A method according to claim 5, wherein the first vapor mixture from the superheater is expanded in a first turbine to a first intermediate pressure level, thereby to produce mechanical work, the partially spent first vapor mixture from said first turbine is recirculated through the superheater to increase its enthalpy and is then expanded in a second turbine to a second intermediate pressure level, thereby to produce additional mechanical work, the vapor mixture emerging from said second turbine is passed through the vapor generator to transfer therein some of its thermal energy to the rich solution, whereafter the vapor mixture is combined with said second vapor mixture from said flash drum, and the combined vapor mixture is expanded in a third turbine to said low pressure level, thereby to generate more mechanical work, and the spent vapor mixture from said third turbine is recycled to the absorber.

7. A method according to claim 6, wherein said second part of said first lean solution emerging from the rectifier is decompressed in two consecutive stages, first to said first intermediate pressure level in a first flash drum and then to said second intermediate pressure level in a second flash drum, the vapor mixture thereby formed in the first flash drum is combined with said partially spent first vapor mixture emerging from said first turbine and is recirculated therewith through the superheater, while the second vapor mixture formed in the second flash drum is combined with the vapor mixture emerging from said second turbine and together therewith is expanded in said third turbine to said low pressure level.

8. A method according to claim 7, wherein the vapor mixture formed in said first flash drum, before it is combined with said partially spent first vapor mixture emerging from said first turbine, is passed through an indirect counter-current heat exchanger, so as to extract heat from the vapor mixture emerging from said second turbine, after its passage through the vapor generator.

9. A method according to claim 1 wherein a portion of of said first part of the rich solution emerging from said preheater at the liquid saturation step is introduced with said second part of the rich solution into said vapor generator and heated there by indirect counter-current heat exchange with the heating fluid to produce said vapor-liquid mixture.

* * * * *